United States Patent [19]

Schuster

[11] 4,354,709

[45] Oct. 19, 1982

[54] FLEXIBLE ELASTIC SUPPORT

[76] Inventor: Wilhelm Schuster, Neubauzeile 57, A 4020 Linz-Donau, Austria

[21] Appl. No.: 51,238

[22] Filed: Jun. 22, 1979

[30] Foreign Application Priority Data

Jun. 23, 1978 [AT] Austria ..... 4599/78

[51] Int. Cl.[3] ..... A47C 7/46

[52] U.S. Cl. ..... 297/284; 297/452; 297/460

[58] Field of Search ..... 297/284, 230, 452, 231, 297/460; 267/89; 5/211, 213, 72, 446, 214–225, 244

[56] References Cited

U.S. PATENT DOCUMENTS

| | | | |
|---|---|---|---|
| 154,454 | 8/1874 | Case | 5/211 |
| 334,556 | 1/1886 | Bedell | 5/214 |
| 614,153 | 11/1898 | West | 297/231 |
| 795,223 | 7/1905 | Hervey | 5/244 |
| 825,577 | 7/1906 | Bezanger et al. | 5/72 |
| 981,966 | 1/1911 | Ambrozy | 5/220 |
| 1,182,854 | 5/1916 | Poler | 297/284 |
| 2,000,624 | 5/1935 | Traver | 297/284 X |
| 2,756,809 | 7/1956 | Endresen | 297/284 |
| 2,843,195 | 7/1958 | Barvaeus | 297/284 |
| 3,158,400 | 11/1964 | Tuhtar | 297/460 |
| 3,241,879 | 3/1966 | Castello et al. | 297/284 |
| 3,490,084 | 1/1970 | Schuster | 297/284 X |
| 3,724,144 | 4/1973 | Schuster | 297/284 |
| 4,153,293 | 5/1979 | Sheldon | 297/284 |

*Primary Examiner*—Francis K. Zugel
*Attorney, Agent, or Firm*—Karl F. Ross

[57] ABSTRACT

An adjustable-curvature structure, e.g. for seat backs, comprises a pair of support belts which are flexible but substantially inextensible, and a pair of tension belts juxtaposed with the support belts. A grid of transverse bars can span the support belts and a tension device is provided between the two pairs of belts so that the support belts can be bowed when the other belts are placed under tension. The curvature character is controlled by spacers which interconnect the support and tension belts to limit the distance between them at various locations along their lengths.

10 Claims, 40 Drawing Figures

FLEXIBLE ELASTIC SUPPORT

FIELD OF THE INVENTION

My present invention relates to a flexible elastic support consisting of at least one band of elastic material which in the longitudinal direction is essentially inextensible and incompressible, and a tensioning element which is fixed to the band and arranged substantially parallel to it. On tensioning of the element, the band, which is supported at one end or at some other point thereof, becomes more or less arched or loadable.

BACKGROUND OF THE INVENTION

Such a known band of metal or plastics, as described in Austrian Pat. No. 292,391, has a U-shaped cross-section and at its edges numerous cutouts provided by stamping as well as tabs which are stamped out from the center of the band and bent round at right angles with holes through which two tensioning elements are guided in the form of cables. As soon as these elements are tensioned by a stretcher, bending of the band occurs evenly over the length of the band or irregularly as a result of the tensioning elements left hanging at the hole edges.

In addition, the wear of the cable-like tensioning elements in the regions of the holes damages these elements so that they must be replaced.

OBJECTS OF THE INVENTION

It is an object of the present invention to provide means in such a support for enabling the curvature in the band to be conveniently shifted to any suitable location. Moreover, the manufacture of the support should be simplified, i.e. it should be possible to produce it with a few simple constructional parts. Finally, such a support should also enable the formation of a support part of a chair, a shoe insert, a mat or a bridge construction, for example, in which more or less substantial curvatures can be generated at any places desired without requiring the use of additional tensioning devices.

SUMMARY OF THE INVENTION

I realize these objects by providing one or more tension belts and support belts with mutually confronting broad sides held together by distance-maintaining pieces or spacers, one or more of which are distributed over the length of the belts or arranged at one or both ends. If the spacers in such a case are arranged on the belts with different mutual separation in the longitudinal direction of the belts, and the tension belt is stressed, then the support belt will develop between the more widely separated spacers a greater curvature than at other locations; that curvature can be readily controlled as to site and extent.

The tension and support belts can be stamped or molded etc. in simple fashion from sheet-steel or other metal, wood, plastics or the like and can be assembled together with similarly simply manufactured spacers so that the support according to the invention can be manufactured with only little expenditure of materials and work.

Another feature of my invention also resides in the fact that some or all of the distance-maintaining pieces or spacers are arranged slidably on the belts which makes it possible to establish where the curvature should form and to what degree and of what shape.

According to a further feature of my invention two or more distance-maintaining pieces are connected together and commonly displaceable by a substantially inextensible and incompressible link. By this means not only can a particularly shaped curvature be achieved in the supporting belt, but it is also possible to shift this curvature from one place to another.

The distance-maintaining pieces can be displaceable with a handle or with a hydraulic, pneumatic, motorized or other drive or provided with a Bowden cable, a knee-joint linkage, a setscrew linkage, a scissors linkage or an eccentric linkage. When the support according to the invention is already installed or mounted, the distance-maintaining pieces covered thereby can nevertheless be easily adjusted from outside by the handle or the like to shift the curvature.

According to a more particular feature of my invention the distance-maintaining pieces can simply be bows which embrace the belts transversely to their longitudinal direction.

On the other hand I may design these pieces as projections on the support belt or the tension belt which engage in apertures of the opposite belt or pass through or embrace same. With this construction there is the possibility of manufacturing the distance-maintaining pieces and the belts from a common starting material, which renders unnecessary the attachment of separate distance-maintaining pieces.

More particularly, the apertures of the tension belt could be formed as slits in which the projections on the support belt may engage with play. Because of such play, with increasing stress in the tension belt an increasing curvature before and behind the respective distance-maintaining piece arises. If the distance-maintaining piece lies at the end of the slit of the tension belt, then on a further increase of the stress in that belt an increase of the curvature takes place only in front of the distance-maintaining piece. Depending upon the size and position of the play, there will be available a rather substantial loadability of the support belt before and behind the slit or along the whole support. By lengthening or shortening the cutout, quite different curvatures or load-sustaining properties can be achieved, with the curvature still capable of displacement.

The above-noted projections can be double rivets or screws etc. with a central or several separate or unitary distance pieces, against which two or more belts lie. By this means it is possible to use commercially available rivets, screws, sockets and packing washers, nuts, etc. whereby the construction of these supports according to the invention is further simplified and decreased in cost.

An important feature of the invention consists in the fact that one or more distance-maintaining pieces can be displaced and adjusted in their effective length by means of screw threads, scissor-lever arrangements, double wires, eccentrics, or hydraulic, pneumatic or Bowden-cable devices. The spacers themselves can accordingly be arranged in fixed position relative to one another, the position of greatest curvature being then selectable as desired by the means mentioned.

BRIEF DESCRIPTION OF THE DRAWING

The above and other features of my invention will now be described in more detail with reference to a few exemplary embodiments shown in the accompanying drawing, in which.

SPECIFIC DESCRIPTION

Figure 1:
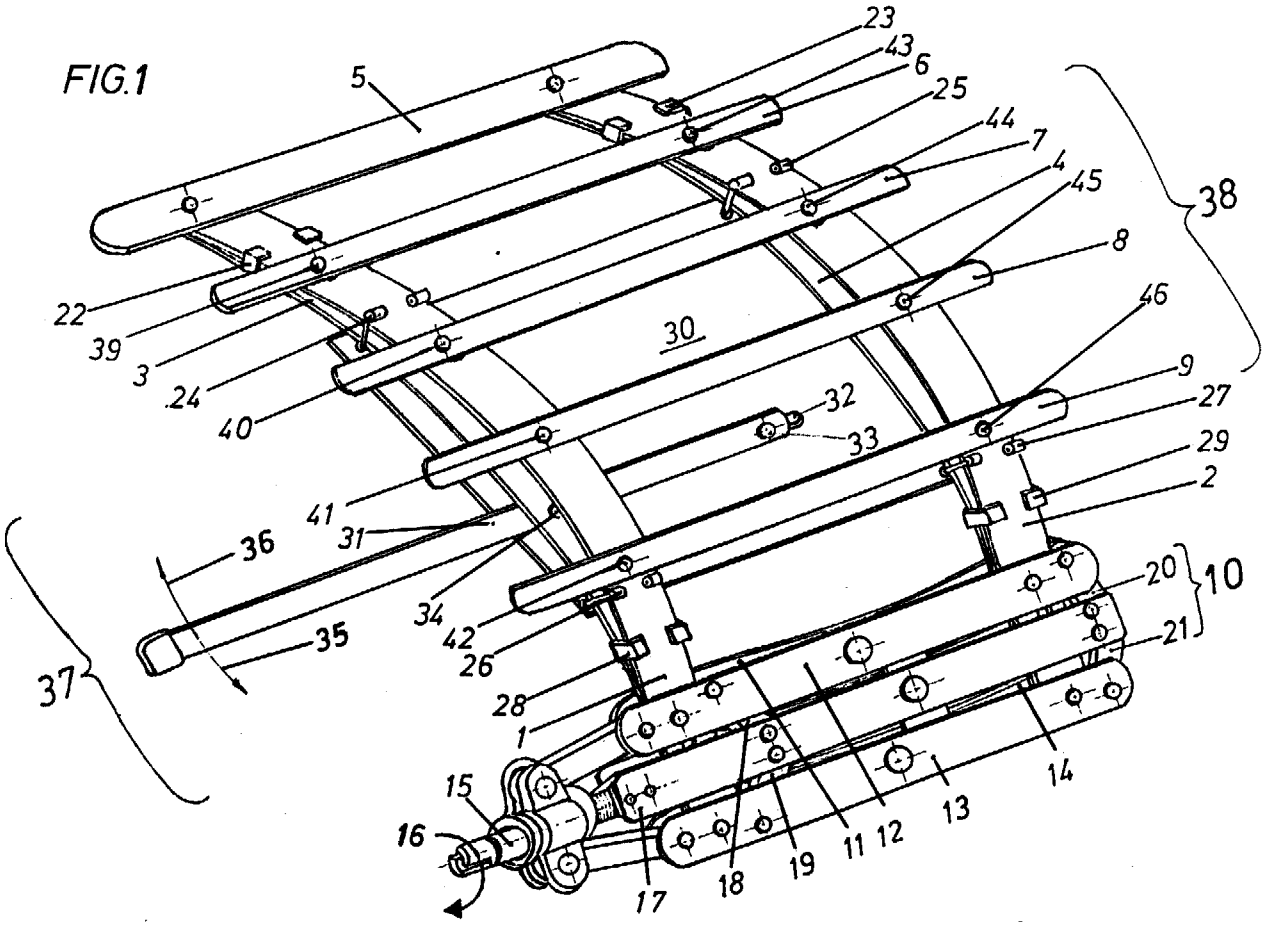
FIG. 1 shows a support constructed according to the present invention in perspective view.

FIG. 1 shows two upper support belts 1, 2 and two underlying tension belts 3, 4 with mutually confronting broad sides which are connected together at one end by one of a plurality of transverse bars 5 to 9 and are held together at their other ends by means of a scissor-lever tensioning device 10 with upper legs 12, 13 fixed to the support belts 1, 2 and with lower legs 11, 14 fixed to the belts 3, 4. If the spindle 15 of this tensioning device is turned e.g. in the direction of arrow 16 by means of a handle or grip not illustrated, then scissor levers 18, 19, 20, 21 linked to a central threaded part 17 traversed by the spindle are brought into their extended position so that the legs 11 to 14 linked thereto are forced apart. By means of this movement a tensile force comes to act on tension belts 3, 4 by means of which the support belts 1, 2 are bent up into the illustrated position.

The tension and support belts 1 to 4 are held together by means of several C-shaped distance-maintaining pieces (spacers) 22 to 29; the central spacers 24 to 27 are anchored to a common plate 30, shown located below the tension belts, and permit a greater separation between the tension and support belts 1, 3 and 2, 4 than the other distance-maintaining pieces 22, 23 and 28, 29. The central distance-maintaining pieces 24 to 27 are provided with rollers on their extremities overlying the support belts 1, 2.

A lever-like handle 31 is articulated to the plate 30 by means of a bolt 33 which passes through a longitudinal slit 32 while the handle is pivoted on tensioning belt 3 at a point 34 around which it may be swung. When handle 31 is swung in the direction of arrow 35, i.e. counterclockwise, the plate 30 is shifted toward the top of FIG. 1 and accordingly all distance-maintaining pieces 24 to 27 are displaced upward; however, on a swinging of handle 31 in the direction of arrow 36, i.e. clockwise, a downward displacement of the plate 30 occurs Since the support belts 1, 2 and/or also the tension belts 3, 4 consist of an elastic material which in the longitudinal direction of the strips is substantially inextensible or incompressible, e.g. iron, sheet steel or plastics, the support belts 1, 2 are bent over their entire length when a tensioning force acts on the tension belts 3, 4. However, at the positions where the separation of the distance-maintaining pieces in the longitudinal direction of the belts is largest, the support belts can bend most so that, in the arrangement shown in FIG. 1, sections 37 and 38 between intermediate pieces 24 to 26 and 25 to 27 are bent most strongly.

By the aforementioned swinging of handle 31 and the consequent displacement of the distance-maintaining pieces 24, 27, however, the curved section 37, 38 can be displaced upward or downward as desired.

The transverse bars 6 to 9 are fixed to the support belts by means of bolts 39 to 46 in such a fashion that they are set at a distance from the belts 1, 2 and allow the passage of the rollers of the slidable distance-maintenance pieces 24 to 27.

One can easily see that the assembly illustrated in FIG. 1 can be built into the rear support part of a seat or bench in a truck or the like and the handle 31 can then project out laterally from the seat back so that simple adjustment of that handle allows matching of the curvature of the seat back to the back of the person sitting on the seat. Similarly, the extent of curvature can be readily adjusted by turning a likewise laterally arranged (but not illustrated) grip located on spindle 15.

By the provision of the rollers on spacers 24 to 27 it is possible to shift the curvature 37, 38 even if the tension belts 3 and 4 are stretched by means of the device 10. Such rollers can also be arranged on the plate 30 below the tension belts in order to reduce the sliding friction between that plate and belts 3, 4.

In place of the rollers mentioned, sliding pieces may be arranged on the ends of the spacers 24 to 27 or between the tension belts 3, 4 and the plate 30.

The handle 31 can be replaced by a hydraulic, pneumatic or motorized drive, the actuation means for such a drive being arranged either in the region of the support or at an appropriate distance therefrom. However, I may also shift the plate 30, directly or via the handle, by a rotary cam.

Figure 2:
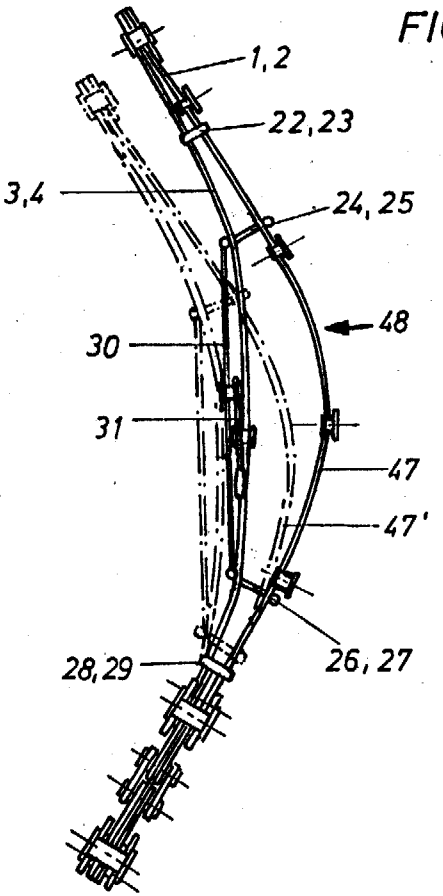
FIG. 2 is a corresponding side view in schematic form.

From the embodiment shown in FIG. 2 it can be seen that the distance-maintenance pieces 24 to 27 form a curvature 47 in the position shown in FIG. 1, about half-way up the support 48. If, however, the distance-maintenance pieces 24 to 27 are pushed downward by swinging the handle 31 in the direction of the arrow 36 (FIG. 1), the curvature 47' indicated by dot-dash lines is generated which is displaced toward the lowest region of the support 48.

Figure 3:
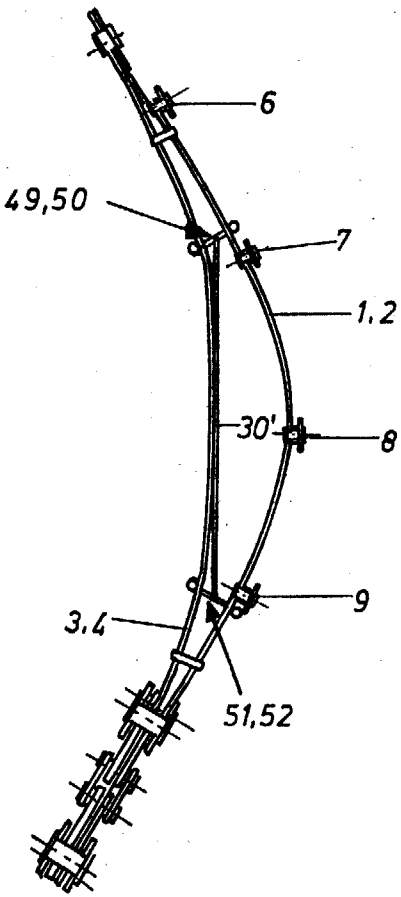
FIG. 3 is a side view of a support according to the invention having distance-maintaining pieces carrying rollers.

In the case of the embodiment shown in FIG. 3, the plate 30' is arranged between the tension belts 3, 4 and the support belts 1, 2 in such a fashion that the four distance-maintenance pieces 49, 50, 51 and 52 connected with it are supported by means of rollers both on the support belts and on the tension belts 1 to 4, and accordingly can slide thereon if plate 30 is displaced. The rollers are so small that they are not hindered in their movement on the support belts 1, 2 by the transverse bars 7, 8, 9. A laterally projecting nonillustrated handle can be fixed to this plate 30', in similar fashion to that shown in FIG. 1, by means of which the displacement of curvature may be effected.

Figures 4, 4A, 5, 5A, 5B, 5C, 6, 6A, 6B, 6C, 6D, 6E:
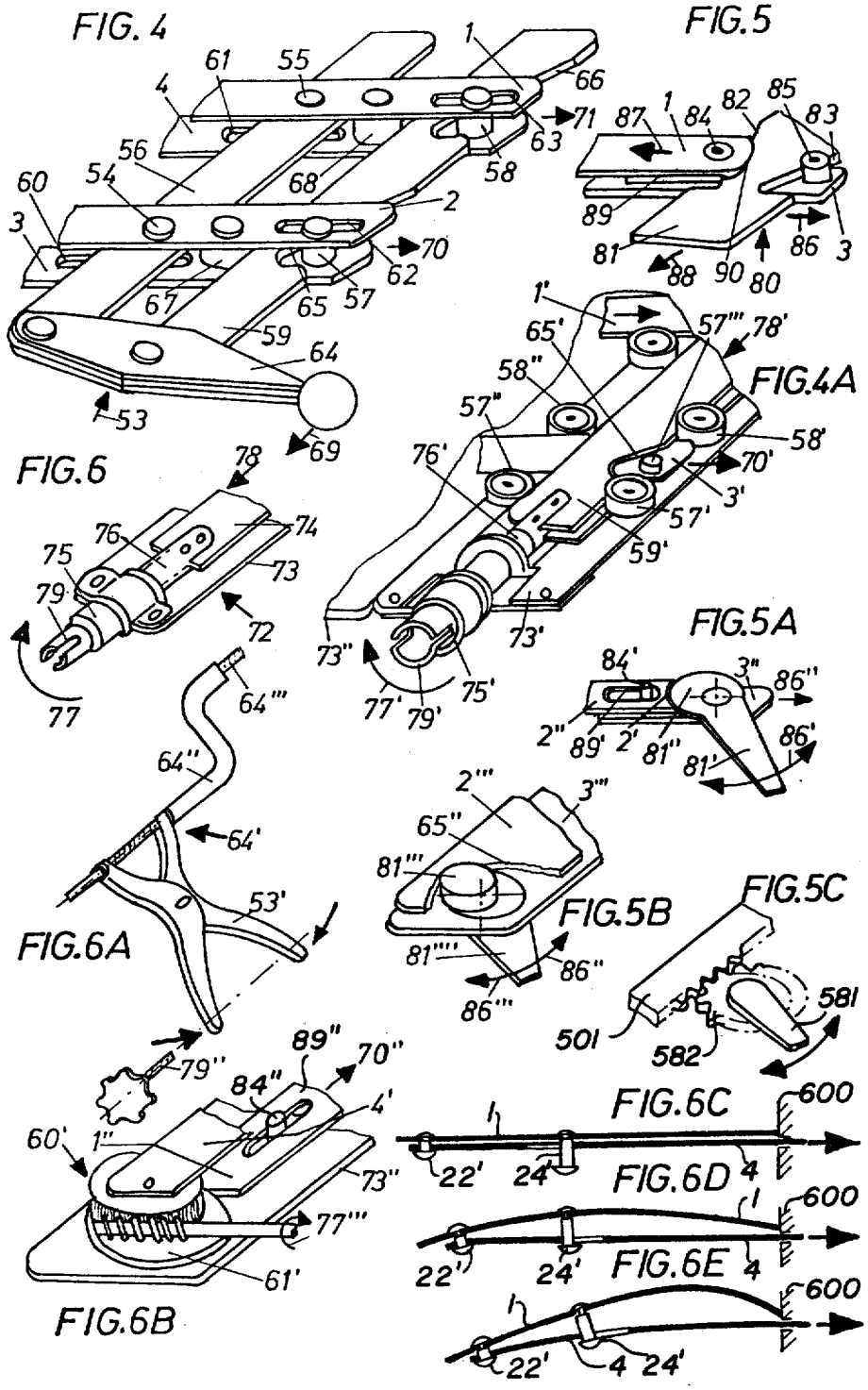
FIGS. 4, 5, 6, 4A, 5A to 5C, and 6A to 6E are perspective views diagrammatically showing various simple embodiments for a tensioning device engaging a support and tension belt.

In the support illustrated in perspective in FIG. 4, a simple tensioning device 53 engaging the ends of two tension and support belts 1 to 4 comprises a transverse bar 56, fixed to the support belts 1, 2 by means of rivets 54, 55 or the like, and a control bar 59, fixed with rivets 57, 58 or the like to the tension belts 3, 4, which is parallel to the transverse bar 56 and like the latter lies between the tension and support belts 3, 1 or 4, 2. The rivets 54, 55 pass through slots 60, 61 in the tension belts 3, 4 and the rivets 57, 58 pass through slots 62, 63 in the support belts 1, 2. The transverse bar 56 and the control bar 59 are each pivotally connected at one end with a hand lever 64.

The control bar 59, at the regions facing rivets 57, 58, is formed on one side with triangular cutouts 65, 66 and on its other side bears upon rollers 67, 68 which are fixed to the support belts 1, 2 and which if desired can also pass through the tension belts 3, 4 by means of posts engaging in longitudinal slots. If, now, the hand lever 64 is swung in the direction of arrow 69, the control bar 59 urges the tension belts 3, 4 via the cutouts 65, 66 and the rivets 57, 58 in the direction of arrows 70, 71, with the rivets 57, 58 sliding in the longitudinal slots 63 of the support belts 1, 2, engaged by the transverse bar 56, whereas the rivets 54, 55 for their part slide in the longitudinal slots 60, 61 of the moving tension belts 3, 4.

For facilitating this tensioning process, the rivets 57, 58 can be rotatably mounted in the tension belts 3, 4 or can be provided with turnable shells.

In place of the tensioning device 53 I may use the device 72 illustrated in FIG. 6 which consists of a base bar 73 firmly connected with the support belts 1, 2 via rollers 67, 68 (FIG. 4) and a control bar 74 slidable thereon which can be constructed like the control bar 59 of tensioning device 53 and act in the same fashion on the tension belts 3, 4 when it is pulled out in the direction of arrow 78 by the turning of a leadscrew assembly 75, 76 as indicated by arrow 78. A bifurcate end 79 of the assembly 75, 76 is engageable for this purpose by a turning knob not shown. Another tensioning device 80, illustrated in FIG. 5, comprises a control bar 81 transversely disposed between supporting and tension belts 1 and 3 and provided with triangular cutouts 82, 83. Each cutout coacts with a respective roller 84, 85 of the support and tensioning belts 1 and 3 and displaces both belts relative to one another in the senses of arrows 86, 87 as soon as the control bar 81 is drawn in the direction of arrow 88. The roller 85 in this case traverses a slot 89 in belt 3 and holds tension and support belts 1, 3 at a distance from one another. The support belt projects with one end 90 beyond the control bar 81, which in this fashion is held at least temporarily between the belts 1, 3.

Alternatively, a double control bar 59' can be arranged to the tension belt 3' and surround same as shown in FIG. 4A, four guide rollers 57', 58', 57'', 58'' being mounted on a common base 73' so as to bracket both the double control bar 59' and the tension belt 3'. The double control bar 59' can be connected with a leadscrew assembly 75', 76', similarly to that of FIG. 6, which is anchored to base 73'; on turning its end 79' in the direction of arrow 77', a displacement of the double control bar 59' is effected in the direction of arrow 78'. By this means the triangular cutout 65' displaces a pin 57''' of the tension belt 3 in the direction of arrow 70', so that a curvature results in the respective support belt (not illustrated).

If several base bars 73', 73'' etc. are set in a row as illustrated in FIG. 4A and are connected in the aforedescribed manner with one or more tension belts 3', 1' by means of distance-maintenance pieces, then these base bars 73', 73'' can take over the function of support belts in which the desired curvature can be generated.

According to FIG. 5A an eccentric lever 81' can be rotatably mounted on the tension belt 3'' and can lie against an end 2' of a support belt 2'' bearing upon an eccentric 81'' integral with that lever whereby a swinging of lever 81' in the direction of arrow 86' (i.e. counterclockwise) moves the tension belt 3'' in the direction of arrow 86'' while a pin 84' thereon slides in slot 89' of the support belt 2''.

A similar sort of sliding action for the support belt 2''' is given in FIG. 5B if a lever 81'''', which passes through the tension belt 3''' with its eccentric 81''', is swung in one or the other direction indicated by arrows 86'', 86''', since the eccentric 81''' then bears upon either one or the other side of a cutout 65'' in the support belt 2'''.

According to FIG. 5C a swinging lever 581 engages with a toothed wheel 582 into toothing on the tension belt 501 and on being turned in one or the other direction effects a displacement of the tension belt relative to the nonillustrated support belt, which in this case carries the fulcrum of the swinging lever 581.

As an alternative to the tensioning leadscrew of FIG. 6 I may use a Bowden cable 64', as shown in FIG. 6A, whose sheath 64'' is anchored to a base and whose core 64''' can engage a nonillustrated control bar or directly the associated tension belt. A scissors lever 53' connected with the Bowden cable can in such a case be operated by means of a spindle 79'' provided with a hand wheel.

According to FIG. 6B, on the other hand, a worm drive 60' with an eccentric disc 61' can lie on a tension belt 1'' which on operation of the worm drive in the direction of the arrow 77''' is displaced in the direction of the arrow 70''. The tension belt 1'' is in this case guided on a base 73'' via a pin 84'' engaging in a slot 89'' of that belt; in the support belt 4', with which belt 1'' can be connected at their nonillustrated ends, a curvature is thus generated.

FIGS. 6C, 6D and 6E illustrate schematically that in a central displacement position of support and tension belts 1, 4 there is generated a curvature over the length of the belts; upon further tensioning of belt 4, a second, stronger curvature can be formed in the support belt 1 between an abutment 600 and distance-maintenance pieces 22', 24'.

Figure 7:
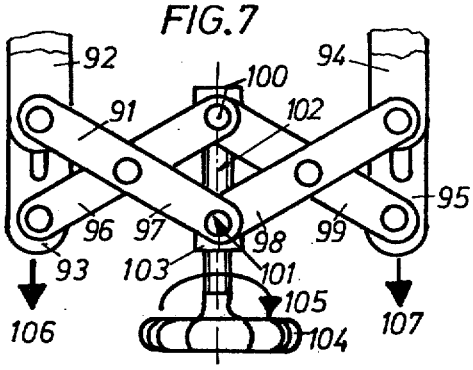
FIGS. 7 to 16 are fragmentary views showing various actuating devices in accordance with my invention.

Another tensioning device 91 is to be seen in FIG. 7. Overlying ends of tension and support belts 92 to 95 are engaged by two scissor-lever linkages 96 to 99, which in turn are connected at pivot points 100 and 101 with a leadscrew 102 and a nut 103 threaded thereon. A turning of a leadscrew handle 104 in the direction of arrow 105 separates the pivot points 100, 101 whereby the tension belts 92 and 95 are displaced in the direction of arrows 106, 107 with reference to the support belts 92 and 94. This establishes in the support belts 92, 94 the desired curvatures which by means of the leadscrew can be exactly adjusted as to magnitude and can also be fixed in the adjusted position.

Figure 9:
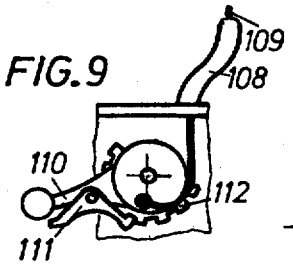

In place of the spindle 102 shown in FIG. 7, a Bowden cable 108, 109 illustrated in FIG. 9 can also engage the pivot points 100, 101, the cable having an adjustment lever 110 and a locking pawl 111 which engages in teeth 112 associated therewith for fixing the selected adjustment position.

Figure 8:
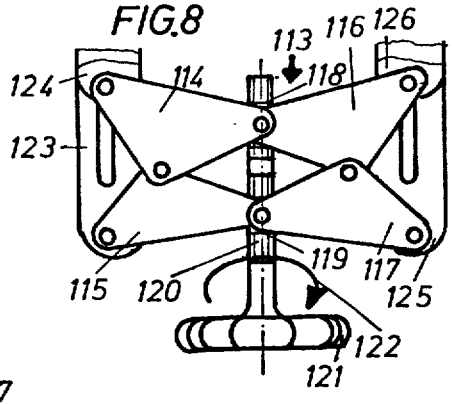

FIG. 8 illustrates a tensioning device 113 which is similar to that of FIG. 7 and which likewise has four lever linkages 114 to 117, with common pivots on a pair of nuts 118 and 119 engaging two threads of opposite pitch on a leadscrew 120 carrying a knob 121; thus, a turning of the knob 121 in the direction of the arrow 122 moves the nuts 118 and 119 towards one another with resulting relative displacement of tension and support belts 123, 124 and 125, 126.

Figure 10:
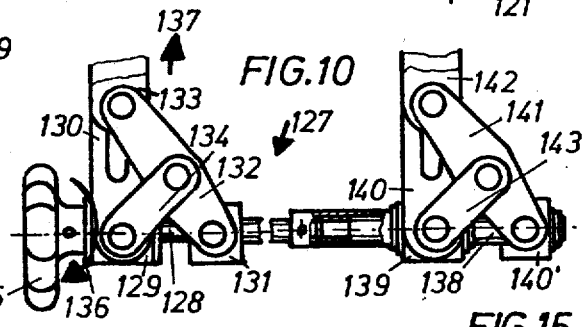

Another simply constructed but particularly effective tensioning device 127 is illustrated in FIG. 10. In this case a leadscrew 128 passes through an end body 129 of one tension belt 130 and engages a nut 131 which is linked to the support belt 133 in pivotal fashion by means of a tie 132 articulated to end body 129 via a further link 134. On turning knob 135 and leadscrew 128 in the direction of arrow 136, the nut 131 approaches the end body 129 of the tension belt 130 so as to displace the support belt 133 in the direction of arrow 137. Again, as in the case of other embodiments shown, the establishment and maintenance of the desired degree of curvature can be accomplished without difficulty.

Leadscrew 128 is shown connected in non-turnable fashion with another leadscrew 138 traversing an end body 139 of a further tension belt 140 and engaging a nut 140', which in turn is pivotally connected via a tie 141 with a further support belt 142; the tie 141 and the end body 139 are articulated to each other by a tie 143. Thus, the right-hand part of the device shown in FIG. 10 carries out the same movements as its left-hand part if knob 135 is turned whereby the desired curvature is generated and fixed in both support belts 133 and 142.

Figure 11:
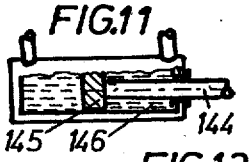

Leadscrew 128, 138 may be replaced, as shown in FIG. 11, by a piston rod 144 of a piston 145 which is loaded from one or the other side in a hydraulic cylinder 146 whereby control movements for forming curvatures in support belts 133, 142 of FIG. 10 can be generated.

Figure 12:
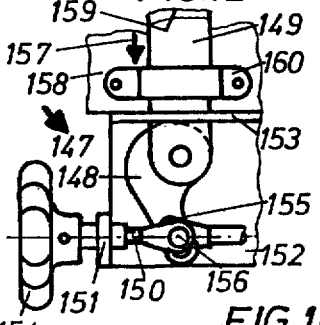
Figure 13:
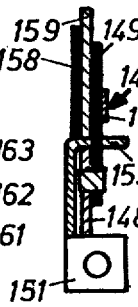
Figure 14:
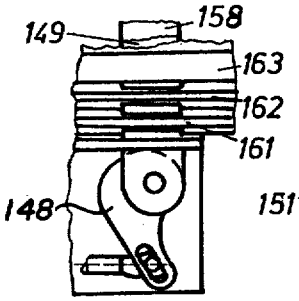

In the embodiment of a tensioning device 147 shown in FIGS. 12 and 14, an eccentric lever 148 is pivoted on a tension belt 149 and articulated to a leadscrew 150 which is supported on an end piece 151 of an angled plate 152; a shoulder 153 of plate 152 abuts the eccentric lever 148. If the leadscrew 150 is turned by means of a hand wheel 154, then a pin 156 thereof engaging in a slot 155 also turns the eccentric lever 158 in such a fashion that the latter moves the tension belt 149 in the direction of arrow 157 relative to the support belt 158 for curving same. The plate-shaped support belt 158 also rests on the shoulder 153 and at its nonillustrated other end is connected with the tension belt 149. A flexible intermediate layer 159 is interposed between belts 158, 149. The support belt 158 is shown to carry a guide 160 surrounding the tension belt 149.

Figure 15:
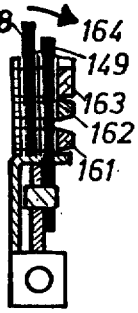

If, as illustrated in FIGS. 14 and 15, the belts 149, 158 are surrounded by broad cover members 161 to 163 which have at least partly wedge-shaped contact faces, then the curvature in the support belt 158 on its movement in the direction of arrow 164 can be intensified until the covering members 161 to 163 lie against one another with their wedge-shaped contact faces. This enables the imposition of different limits upon the curvature of the belt at various locations. In the region of a cover member 163 of rectangular cross-section, for example, the curvature will be less than in the region of members 161 and 163 whose cross-section is trapezoidal.

Figure 16:
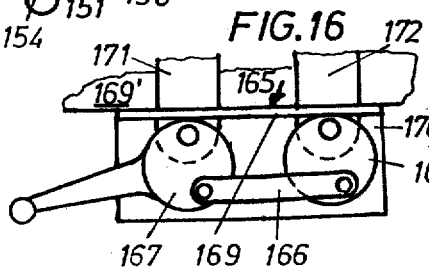

In the tensioning device 165 shown in FIG. 16, two eccentric levers 167, 168 connected by means of a tie 166 with one another bear upon a shoulder 169 of an angled plate 170 and are pivotally connected with two tension belts 171, 172 which pass through the shoulder 169 and are guided thereby. An underlying support belt in the form of a single plate 169' rests only against the shoulder 169 and, depending upon the swing angle of the eccentric levers 167, assumes a more or less pronounced curvature. The single plate 169' can be replaced by individual belts in which the desired curvature is generated.

Figure 17:
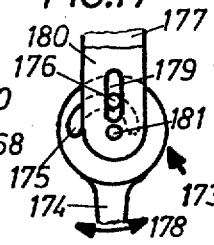

According to a further embodiment of the invention which is illustrated in FIG. 17, a tensioning device 173 consists of an eccentric lever 174 with an eccentrically curved slot 175 in which a pin 176 of the tension belt 177 engages. A turning of the eccentric lever 174 in the direction of arrow 178 moves the pin 176 in the arcuate slot 175 and also along the longitudinal slot 179 of the support belt 180; a relative displacement then occurs between tension and support belts 177 and 180 since the support belt 180 is fixed at the fulcrum 181 of the lever 174. Thus displacement of the tension belt 177 again leads to a more or less great curvature in the support belt 180, the exact amount depending upon how far lever 174 is swung.

Figure 19:
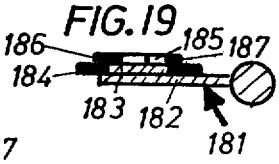
FIGS. 17 to 19 are, respectively, plan, side and sectional views of a tensioning device which is fixed on to the tension and support belts.
Figure 18:
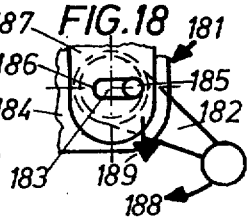

A further tensioning device 181, illustrated in FIGS. 18 and 19, comprises an eccentric lever 182 which engages with an extremity designed as a circular disc 183 in a corresponding aperture of the support belt 184. On the disc 183 there sits eccentrically a pin 185, which in turn engages in a transverse slot 186 of the tension belt 187. On a swinging movement of lever 182 in the direction of the arrow 188 the pin 185 slides in the transverse slot 186 while simultaneously entraining the tension belt 187 in the direction of arrow 189, so that in this case the support belt 184 which is constructed as a plate is curved strongly depending upon how far lever 182 is swung.

Figure 20:
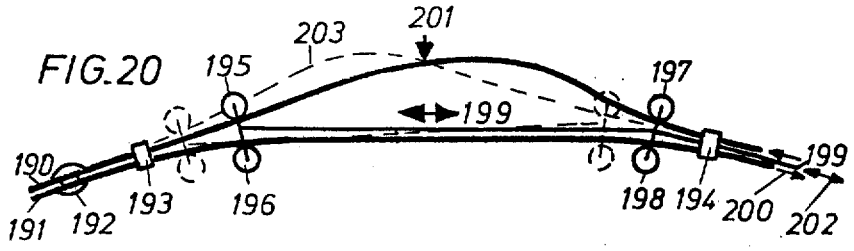
FIGS. 20 to 24 are schematic side views of a support according to the invention.

From FIG. 20 a particularly simply set curvature of a support according to the present invention is evident. Support and tension belts 190, 191 are fixedly connected to one another at one end by means of a rivet 192 or the like. Two or more distance-maintenance pieces 193, 194 can embrace the belts 190, 191 loosely or fixedly. Further spacers or separation pieces in the form of interconnected roller pairs 195, 196, 197, 198 are jointly displaceable on the belts 190, 191 by means of an additional stiff control belt 199, which links the two roller pairs 195 to 198 and can be guided between support and tension belts 190, 191. If via the tension belt 191 a pull in the direction of arrow 200 is exerted on the support, a curvature 201 forms in the support belt 190 between the roller pairs and can be displaced via the control belt 199 according to its movement in one or the other direction (arrow 202). The most widely separated curvatures which can be formed by displacement are illustrated with a solid line 201 and with a dashed line 203. The control belt 199 can be connected with a nonillustrated handle, or can be driven by means of a motor, hydraulically, electromagnetically or otherwise. Since the roller pairs 195 to 198 movable on the belts 190, 191 have only a small rolling resistance, their adjustment is possible even if the curvature 201 in the support belt 190 is very strongly pronounced.

Figure 21:
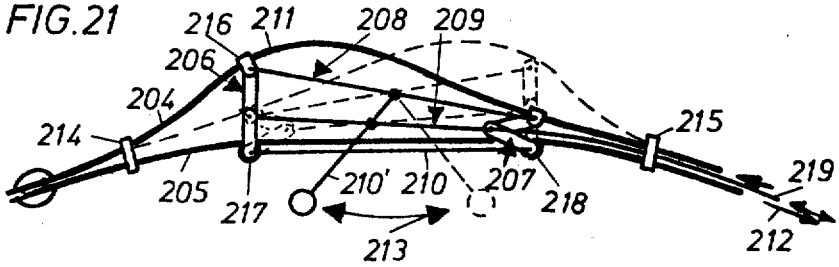

Another type of adjustment of such curvature within the support belt is illustrated in FIG. 21. In this case the support and tension belts 204 and 205 are articulated to pairs of elbow levers 206, 207 which serve as distance-maintenance pieces and are connected with one another by means of arms 208, 209 and 210. A handle 210' articulated to the arms 208, 209 enables one elbow lever to be extended while the other is folded up.

In the position illustrated in FIG. 21, the elbow lever 206 is extended so that the curvature 211 comes into existence on the left-hand side of the support belt 204 after a force in the direction of arrow 212 has been exerted on tension belt 205.

By swinging the handle 210 in the direction of arrow 213, the elbow lever 206 is folded up and the other elbow lever 207 is extended, as illustrated by dashed lines. By means of this displacement the curvature 211 is shifted towards the right-hand side of the support belt 204 as likewise indicated in dashed lines.

The distance-maintenance piece 214 located on the fixed ends of belts 204, 205 can be fixedly positioned thereon. The other distance-maintenance piece 215 is advantageously firmly connected only with support belt 204 while slidably embracing the tension belt 205.

The elbow lever 206 is articulated to support belt 204 by means of a lug 216. Levers 206, 207, on the other hand, engage the underside of the tension belt 205 with rollers 217 and 218 which create equilibrium movement if tension and support belts are slid relative to one another.

A control belt 219 operable from outside can also engage the elbow lever 207 and can be operated in the same way as control belt 199 of FIG. 20.

Figure 22:
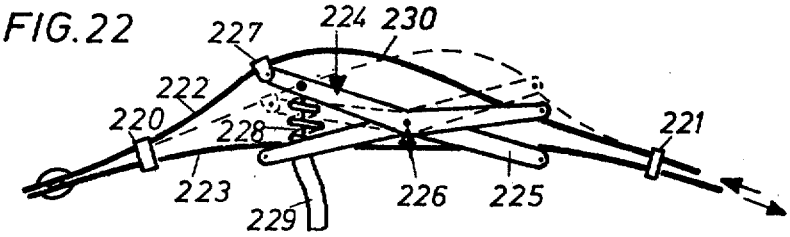

Support and tension belts 222 to 223, which are illustrated in FIG. 22 and held together by distance-maintenance pieces 220 and 221, are attached to the ends of two obtuse-angled scissor levers 224, 225 which are pivotally connected with one another at 226. A Bowden cable 228 engages the lever 224 which is articulated by means of a lug 227 to the support belt 222, the sheath 229 of the Bowden cable being secured to the other lever 225. By operating the Bowden cable 228, as is evident from the dashed lines, the curvature 230 produced in support belt 222 is displaced to the right as seen in FIG. 22, because the scissor levers 224, 225 are on one side brought closer to one another at one end and are moved apart at the other end. In place of the Bowden cable I may use a screw, an eccentric or the like bearing upon adjoining lever ends.

Figure 23:
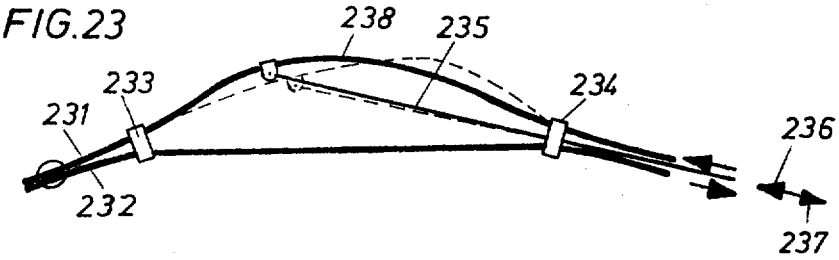
Figure 24:
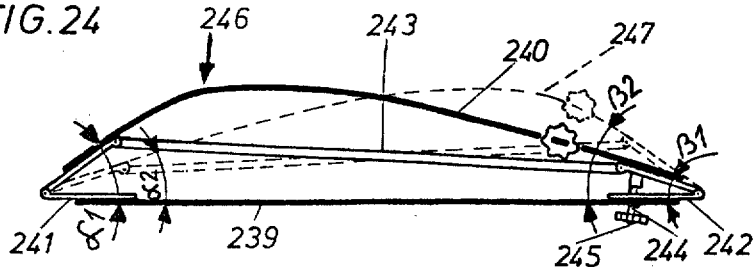

A particularly simple embodiment of the invention is shown in FIG. 23. Between tension and support belts 231, 232, interconnected at one end and held together by means of distance-maintenance pieces 233, 234, there is arranged a stiff control belt 235 engaging the support belt 231 under tension or pressure exerted in one or the other direction 236, 237 whereby a curvature 238 generated in support belt 231 by means of the tension belt 232 can be displaced. The displacement of the curvature to the right is illustrated with dashed lines. According to the embodiment of FIG. 24, the tension and support belts 239, 240 are firmly connected at their ends with respective hinges 241, 242, the upper hinge parts being interconnected by means of a linkage arm 243. The hinge 242 is engaged by a leadscrew 244 with a grip 245 which can be turned in one direction to adjust the angle $\beta_1$ between the hinge parts to a greater value $\beta_2$. Upon such adjustment, the angle $\alpha_1$ between the parts of the other hinge 241 also varies to a smaller value $\alpha_2$, so that the curvature 246 previously formed in the support belt 240 is displaced along the support as illustrated by a dashed line 247. It is clear that, depending upon the rotation of leadscrew 244, the curvature can assume any desired intermediate position between the two extreme positions illustrated.

Figure 25:
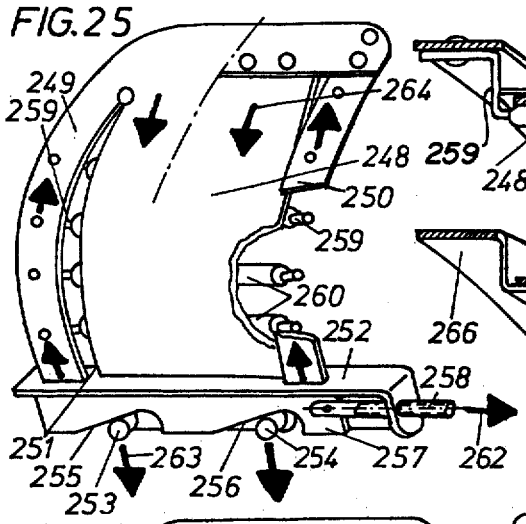
FIGS. 25 to 29 are perspective views showing modified supports in the form of seat backs.
Figure 26:
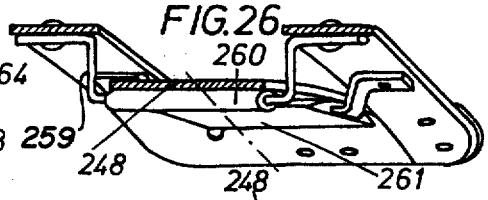

In the embodiment of the invention illustrated in FIG. 25, a more or less broad tension belt 248 is unitarily connected with two lateral support belts 249, 250 at its upper end and has a lower end passing through a slot 251 of an angle piece 252. This lower end is provided with pins 253, 254 resting against triangular cutouts 255, 256 of a slider 257 which bears upon the long shoulder of the angle piece 252 from below and is attached to a leadscrew 258 in threaded engagement with the short shoulder of this piece 252. Against the upper side of the long shoulder of the angle piece 252 abut the free ends of the support belts 249, 250. On their rear side U-shaped yokes 259 with rollers 260 or slide pieces 261 are provided against which the tension belt 248 comes to rest (see also FIG. 26).

If the leadscrew 258 is turned so as to move in the direction of the arrow 262, the pins 253, 254 are displaced in the direction of arrows 263 so that the tension belt 248 which lies against the rollers 260 is likewise moved downward (arrow 264) whereby any curvature already previously present in the support belts 249 is increased.

Figure 27:
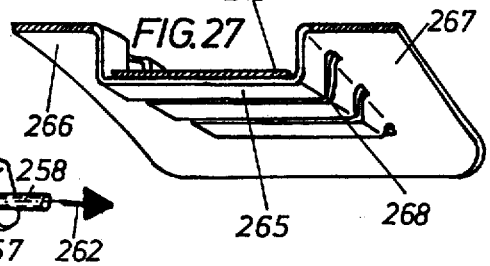

According to FIG. 27, a yoke 265 may constitute a unit with the support belts 266, 267 and slits 268 may be formed between them which are so broad that a stressing of the tension belt 248 which slides on the yokes 265, i.e. the attainment of the greatest possible curvature of the support belts 266, 267, causes these yokes to close up. The bars of these yokes 265 thus bear on one another in the most curved position of the support.

Figure 28:
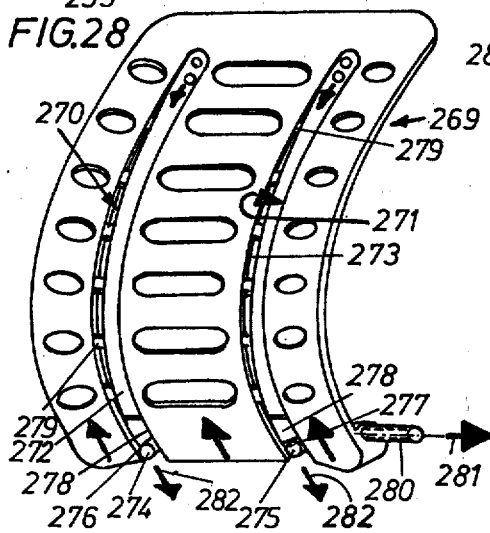

The support according to the invention shown in FIG. 28 consists of a body 269 in the shape of a seat back and formed of plywood, metal, plastics or the like which can be injection molded, drawn or stamped. It has downwardly extending cutouts 270, 271 accommodating tension belts 272, 273 which are fixed at their upper ends to the body 269. These belts are provided at their lower free ends with pins 274, 275 resting, as in the embodiment of the invention shown in FIG. 25, against triangular cutouts 276, 277 of a slider 278 which is supported and guided in the lower part of body 269.

Provided on the rear side of body 269 are yokes 279 which serve as a support for the tension belts 272, 273. If a leadscrew 280 connected with the slider 278 and in threaded engagement with body 269 is turned so as to move in the direction of arrow 281, the coaction of the pins 274, 275 with the cutouts 276, 277 of the slider 278 causes a movement of the tension belts 272, 273 in the direction of arrows 282 so that these tension belts are stressed. Their tensioning effects a further bending of the body 269, which can already have a certain curvature.

Figure 29:
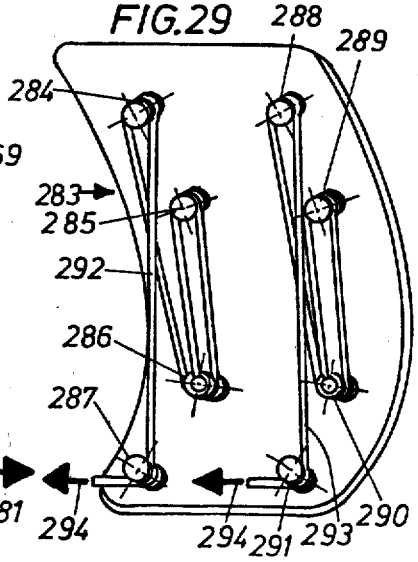

A yet simpler way of realizing my invention is illustrated in FIG. 29. An initially curved support 283 has on its rear side one or more vertical rows of rollers 284 to 291 around which tension belts 292, 293 are wound. Each belt has one end fixed to roller 286 or 290 and is led around the rollers 285, 286, 284 and 287 or 289, 290, 288 and 291, respectively, in zig-zag shape while extending from the lower region of the support 283 substantially horizontally to a tensioning device not illustrated.

If a pulling force is applied to the lower ends of the tension belts 292, 293 in the direction of arrows 294, then the vertically separated rollers engaged thereby approach one another and thereby enhance the curvature of support 283 which can be exactly adjusted to the desired degree of bending and fixed in that position.

By means of the rollers or sliding elements on the distance-maintenance pieces described with reference to the embodiments of FIGS. 2, 3, 20, 23 and 29, or by means e.g. of reciprocally acting elbow levers, scissor levers, linkages or the like (FIGS. 21, 22, 24, 25, 27 and 28) as well as by means of additional tensioning of compression elements (FIG. 23) the curvature within the supports according to the invention, and accordingly also within a seat, bridge, concrete construction or carrier into which the support is built, can be displaced with a small additional "secondary force" even with partial or total loading of the support at the time.

All or some of the supports can also have overall or locally effective compression or tensioning elements, distance-maintenance pieces, control mechanisms or additional springs designed to impart to them inherent curvatures to which the support will automatically return as soon as the influence exerted by a tensioning device disappears. By this means the alteration and/or displacement of one or more curvatures can be achieved by "relaxation" in place of tensioning, pulling or pressure forces, or by external influences (e.g. leaning on it) so that the particular curvature can be "frozen" e.g. by clamping, by means of a cross-bar or by further turning or relaxation of the control or tensioning device. All the mentioned features of the invention are accordingly combinable with one another or exchangeable at will and are also combinable or exchangeable with any other constructional elements (directly or via damping or other auxiliary means).

Figure 30:
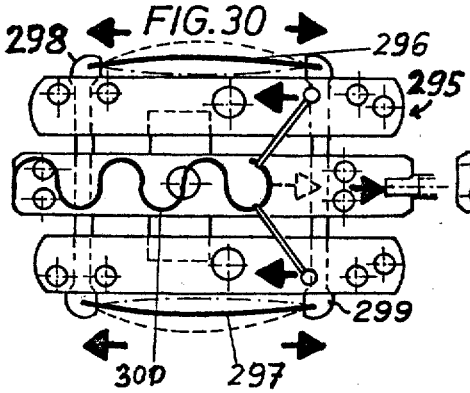
FIGS. 30 and 31 are elevational views diagrammatically illustrating respective tensioning devices which may be supported by springs.

In FIG. 30 a tensioning device 295 is illustrated which corresponds essentially to that of FIG. 1, except for the leaf springs 296, 297 which have an inherent outwardly concave shape indicated in phantom lines but are prevented by means of stops or other obstacles from moving toward each other. The starting position for longitudinal loading is a slight opposite curving as shown in full lines. On further loading in their longitudinal direction, the springs can only deflect outward against their inherent curvature to the dashed-line position. If the springs 296, 297 so inverted bear via the connection members 298, 299 against the ties of tensioning device 295, then this device is braced as indicated by arrows. The same effect may be achieved by means of the S-shaped spring 300 which engages the individual tie members of tensioning device 295.

Figure 31:
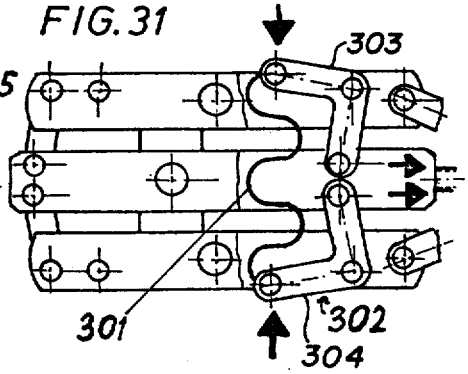

According to the embodiment of FIG. 31, a similarly S-shaped spring 301 engages elbow levers 303, 304 of a similar tensioning device 302 and braces same.

I claim:

1. A flexible elastic supporting structure comprising:

an elongate flexible and longitudinally substantially inextensible and incompressible band forming a support belt;

an elongate flexible and generally flat element forming a tension belt secured at one end thereof to a corresponding end of said band, said support and tension belts having mutually confronting broad sides and being generally parallel to and coextensive with each other;

adjustment means engaging the other ends of said belts for relatively shifting same longitudinally while maintaining said tension belt under stress whereby a convex curvature away from said tension belt is imparted to said support belt;

a plurality of distance-maintaining pieces engaging said belts at longitudinally separated intermediate locations for keeping said belts spaced apart transversely to said confronting sides by predetermined distances at said intermediate locations, several of said pieces being slidable along said belts;

a substantially inextensible and incompressible link interconnecting said slidable pieces; and an operating member mechanically connected with said link for jointly displacing said slidable pieces longitudinally of said belts to shift said convex curvature.

2. A supporting structure as defined in claim 1 wherein said several of said pieces are generally C-shaped members with extremities overlying said belts.

3. A supporting structure as defined in claim 1 or 2 wherein said several of said pieces are provided with rollers contacting said belts.

4. A supporting structure as defined in claim 1 or 2 wherein said support and tension belts are part of a pair of parallel support belts and a pair of parallel tension belts in mutually confronting relationship and with ends engaged by said adjustment means, said distance-maintaining pieces forming two sets each engaging a respective tension belt and a respective support belt.

5. A supporting structure as defined in claim 4 wherein said support belts are interconnected by a multiplicity of transverse bars.

6. A supporting structure as defined in claim 4 wherein said link comprises a plate connected with distance-maintaining pieces of both sets.

7. A supporting structure as defined in claim 6 wherein said operating member comprises a handle pivoted to said plate and to one of said tension belts.

8. A supporting structure as defined in claim 6 wherein said plate is disposed on a side of said tension belts remote from said support belts.

9. A supporting structure as defined in claim 6 wherein said plate is inserted between said tension belts and said support belts.

10. A supporting structure as defined in claim 3 wherein said link is a stiff further belt.

* * * * *